US009080286B2

(12) United States Patent
Mattelmäki et al.

(10) Patent No.: US 9,080,286 B2
(45) Date of Patent: Jul. 14, 2015

(54) METHOD IN THE TREATMENT OF ODOROUS GASES OF A CHEMICAL PULP MILL

(75) Inventors: Esko Mattelmäki, Porvoo (FI); Kari Saviharju, Espoo (FI)

(73) Assignee: Andritz OY, Helsinki (FI)

( * ) Notice: Subject to any disclaimer, the term of this patent is extended or adjusted under 35 U.S.C. 154(b) by 990 days.

(21) Appl. No.: 12/675,249

(22) PCT Filed: Aug. 20, 2008

(86) PCT No.: PCT/FI2008/000094

§ 371 (c)(1),
(2), (4) Date: Jan. 31, 2011

(87) PCT Pub. No.: WO2009/030805

PCT Pub. Date: Mar. 12, 2009

(65) Prior Publication Data

US 2011/0280762 A1 Nov. 17, 2011

(30) Foreign Application Priority Data

Sep. 3, 2007 (FI) ..... 20070671

(51) Int. Cl.
*D21C 11/08* (2006.01)
*D21C 11/12* (2006.01)

(52) U.S. Cl.
CPC ..... *D21C 11/08* (2013.01); *D21C 11/127* (2013.01)

(58) Field of Classification Search
CPC ..... D21C 11/08; D21C 11/127
USPC ..... 422/123, 169–170, 185
See application file for complete search history.

(56) References Cited

U.S. PATENT DOCUMENTS

| | | | | |
|---|---|---|---|---|
| 3,431,165 | A * | 3/1969 | Buxton, Jr. | 162/30.11 |
| 3,842,160 | A * | 10/1974 | Brannland et al. | 423/243.09 |
| 4,872,950 | A * | 10/1989 | Andersson et al. | 162/15 |
| 5,450,821 | A * | 9/1995 | Kalina | 122/1 R |
| 5,545,292 | A * | 8/1996 | Empie | 162/30.11 |
| 5,562,804 | A * | 10/1996 | Tuominiemi et al. | 162/15 |
| 5,624,470 | A * | 4/1997 | Tanca | 48/7 |
| 5,639,434 | A * | 6/1997 | Patrikainen et al. | 423/235 |
| 5,989,387 | A * | 11/1999 | Hyoty et al. | 162/15 |
| 6,030,493 | A * | 2/2000 | Nilsson | 162/30.1 |
| 6,030,494 | A * | 2/2000 | Hupa et al. | 162/51 |
| 6,136,144 | A * | 10/2000 | Martin et al. | 162/14 |

FOREIGN PATENT DOCUMENTS

| | | | |
|---|---|---|---|
| CA | 2 078 959 | A1 | 3/1993 |
| EP | 1 524 241 | A1 | 4/2005 |
| WO | 79/00899 | A1 | 11/1979 |
| WO | 2005033404 | A1 | 4/2005 |

OTHER PUBLICATIONS

International Search Report mailed Mar. 30, 2009.

* cited by examiner

*Primary Examiner* — Regina M Yoo
(74) *Attorney, Agent, or Firm* — Nixon & Vanderhye P.C.

(57) ABSTRACT

A method for treating odorous gases of a chemical pulp mill, according to which method odorous gases are combusted in a separate combustion device and flue gas generated therein is scrubbed. The scrubbed flue gas is led into a recovery boiler. The flue gas is scrubbed in a series of scrubbers wherein scrubbing solution discharged from one scrubber may be fed to a preceding scrubber.

21 Claims, 1 Drawing Sheet

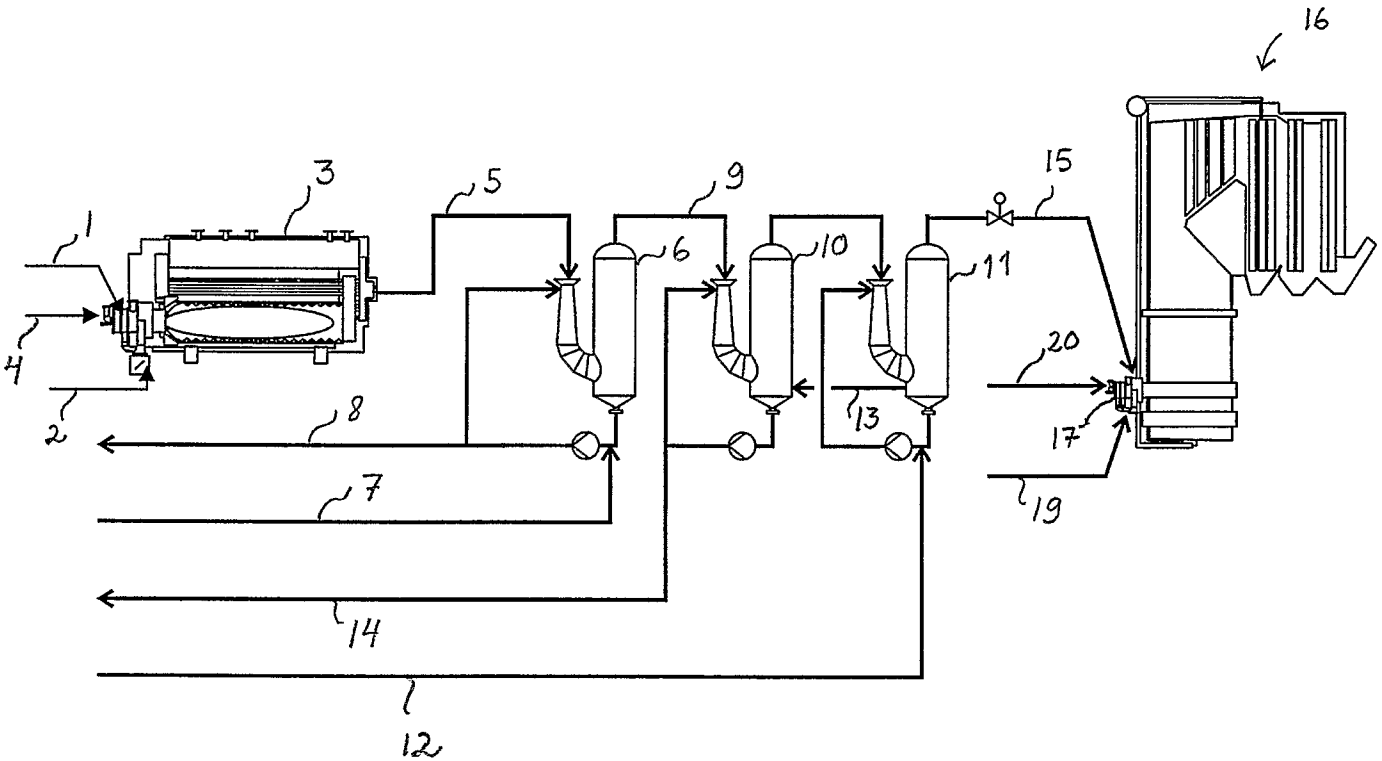
16
15
20
17
19
11
13
10
9
6
5
3
8
7
14
12
1
4
2

METHOD IN THE TREATMENT OF ODOROUS GASES OF A CHEMICAL PULP MILL

This application is the U.S. national phase of International Application No. PCT/FI2008/000094 filed 20 Aug. 2008 which designated the U.S. and claims priority to Finnish Patent Application No. 20070671 filed 3 Sep. 2007, the entire content of which is hereby incorporated by reference.

BACKGROUND OF THE INVENTION

The present invention relates to a method for treating odorous gases of a chemical pulp mill and for improving the control of nitrogen oxide emissions.

In sulfate pulping, wood is treated in white liquor containing sodium hydroxide and sodium sulfide, whereby the lignin is hydrolyzed. Thereby several organic sulfur compounds are formed, such as methylmerkaptan, dimethylsulfide and dimethyldisulfide. These very compounds together with hydrogen sulfide cause the unpleasant smell of exhaust gases of chemical pulp mills. These gases are formed in several stages of a chemical pulping process, such as at the digester plant and the waste liquor evaporation. Malodorous sulfur compounds are removed most usually by collecting the malodorous gases from various sources and by combusting them either in a lime kiln, a chemical recovery boiler or a separate combustion apparatus. During combustion all sulfur-containing substances are oxidized to sulfur dioxide, sulfur trioxide, and, in the presence of alkali, also to sodium sulfate, and they are passed into flue gases.

In addition to sulfur compounds, digestion generates also methanol and ammonia. Vapors containing sulfur compounds, ammonia and methanol are released abundantly for instance in black liquor evaporation, where said compounds are distilled and condensed into condensates of a multistage evaporation plant. Foul condensates are usually purified in a steam stripper, where the condensate and steam are put into contact with each other and impurities are transferred from the condensate into the steam, while the condensate stream is obtained in purified form for further use. The exhaust vapor from the stripper is led via a post-condenser to combustion or directly to methanol liquefaction. Non-condensable gases (NCG) are combusted together with the flow of other odorous gases of the mill.

The odorous gases are typically divided into strong odor gases (LVHC Low Volume High Concentration) and dilute odorous gases (HVLC, High Volume Low Concentration). The strong odorous gases originate mainly from the digester plant, the evaporation plant or stripping. Dilute odorous gases are collected from containers and devices from the fiber line, evaporation plant, tall oil plant and causticizing plant. Dilute odorous gases contain the same components as the strong odorous gases, but they also contain so much air that the concentrations are remarkably lower.

The purpose of odorous gas combustion is to oxidize the reduced sulfur compounds contained in the gas, such as hydrogen sulfide, sulfur dioxide, and therefore the combustion is to take place in the presence of a remarkable volume of excess air (e.g. approximately 3-4%) and at a high temperature. Thereby the ammonia contained in the odorous gas is in its turn oxidized into nitrogen oxides. Especially the strong odorous gases contain nitrogen compounds, so that their combustion specifically has an influence on the nitrogen oxide emissions of the mill.

Finnish patent publication 105215 discloses a method, in which ammonia is removed from odorous gases prior to their combustion, whereby the nitrogen oxide content of the flue gas generated in the combustion can be significantly reduced. Preferably the ammonia is removed by scrubbing said gases in order to bind the ammonia off them. The scrubbing solution can preferably be a bisulfite solution originating from the scrubbing of flue gases formed in the combustion of the gases. Some other applicable solution originating from the chemical pulp mill and having a pH in the neutral or acid range, such as acid bleaching effluent or waste acid from the chlorine dioxide plant can also be used.

SUMMARY OF THE INVENTION

In view of the detrimental nitrogen compound emissions of the chemical pulp mill, a specific problem may be separate combustion of strong odorous gases.

A method and system to minimize the nitrogen oxide emissions of the flue gases of odorous gas combustion has been invented. The method controls the emissions of detrimental nitrogen compounds, especially nitrogen oxides, from a chemical pulp mill in a way that may be more efficient than the prior methods when practicing separate combustion of odorous gases.

Odorous gases of a chemical pulp mill are combusted in a separate combustion device and flue gas generated therein is scrubbed. The scrubbed flue gas is led into a chemical recovery boiler.

An advantage of the invention in this regard is that the nitrogen oxides (NOx) in the flue gases of the separate combustion are not released into the atmosphere. The NOx-content of the recovery boiler flue gases does not increase substantially or at all, although the flue gas from the odorous gas combustion is fed into the boiler.

Especially strong odorous gases are treated by combustion in a way known per se in a separate combustion device, such as a fire tube boiler. In this boiler, the fuel and combustion air are typically fed in via one end of a typically horizontal tubular boiler space and the flue gases generated in the combustion are discharged via the opposite end of the boiler. Preferably this kind of a boiler is provided with a separate odorous gas burner, where the strong odorous gases are combusted.

The flue gas generated in the odorous gas combustion device is scrubbed for removing sulfur compounds. The flue gas is scrubbed in at least two stages. In the first stage the flue gas is scrubbed with a sodium hydroxide-containing solution, whereby sodiumbisulfite ($NaHSO_3$) is generated. Bisulfite is required at a chemical pulp mill, e.g. in the pulp bleaching plant in destroying bleaching chemical residuals, such as chlorine dioxide residuals. In the first flue gas scrubbing stage, the amount of bisulfite needed at the mill can advantageously be produced for a specific purpose.

The next scrubbing stage comprises removing from the flue gas sulfur compounds, such as sulfur dioxide, formed in the combustion, whereby the scrubbing solution is preferably oxidized white liquor. The desulfuration stage is preferably carried out in two scrubbers. Fresh scrubbing solution is led in the flue gas flow direction into the latter scrubber, wherefrom the scrubbing solution is further led to a preceding scrubber. In the desulfuration, the sulfur oxides of the flue gas react into sulfites, and the scrubbing solution containing the sulfites is led into the chemical cycle of the mill, for instance via a white liquor tank.

The scrubbed cooled flue gas is led into a recovery boiler. According to an embodiment, the scrubbed flue gas is led into a burner mounted in the recovery boiler, which burner also receives air and preferably methanol and if required, other substance in addition to the flue gas. The burner can be a device similar to a typical odorous gas burner. It can be located at the secondary air level in the recovery boiler.

According to another embodiment, the scrubbed flue gas coming from the odorous gas combustion can be led directly into the recovery boiler, for instance via the air ports for combustion air, in a way similar to the leading of dilute odorous gases to the recovery boiler as combustion air. The flow rate of the scrubbed flue gas is so low compared to e.g. the combustion air amount of the recovery boiler that this kind of introduction thereof into the recovery boiler does not deteriorate the operation of the boiler.

SUMMARY OF DRAWINGS

The invention is described in more detail in the appended drawing, which illustrates schematically a preferred embodiment of the invention.

FIG. 1 is a schematic illustration of a system to treat flue gas generated in the Combustion of odorous gas.

DETAILED DESCRIPTION

FIG. 1 illustrates the treatment of flue gas generated in the combustion of odorous gases. Strong odorous gases 1 are led into a separate combustion device 3, which typically is a fire tube boiler. Also air 2 and other required substances 4 are led into the combustion. The flue gas generated in the combustion is led via line 5 to scrubbing, where in the first stage the flue gas is scrubbed in a Venturi scrubber 6 with a sodium hydroxide containing solution 7. The sulfur dioxide contained in the flue gas reacts with sodium hydroxide, whereby sodium-bisulfite is formed and the solution 8 containing sodium-bisulfite can be used in the processes of the chemical pulp mill, for instance as anti-chlor in pulp bleaching. The bisulfite solution amount required at the mill can preferably be produced in the first flue gas scrubbing stage.

From the first scrubber 6 the flue gas is led via line 9 into two subsequent scrubbers 10 and 11 of the following scrubbing stage. A scrubbing solution 12, preferably oxidized white liquor, binding the sulfur compounds of the flue gas is led in the flue gas flow direction into the latter scrubber 11. From there the scrubbing solution is led via line 13 directly to the preceding scrubber 10, wherefrom the sodium sulfite containing scrubbing solution is led via line 14 e.g. into a white liquor tank (not shown).

The scrubbed flue gas is led in the flue gas flow direction from the last scrubber 11 via line 15 into the recovery boiler 16. In the embodiment according to the FIGURE a burner 17 has been installed in a wall of the recovery boiler, into which burner air via line and e.g. methanol via line 20 are led in addition to the scrubbed flue gas.

An advantage of the present invention is that the NOx in the flue gas of the separate combustion of odorous gases is not released into the surrounding atmosphere, but the scrubbed flue gas is led into the recovery boiler to be treated therein. The NOx-content of the recovery boiler does not increase at all, or at least does not substantially increase, although flue gases are fed into the boiler. Total emissions from a pulp mill in view of NOx can even be reduced compared to a situation, wherein a scrubbed flue gas of the separate combustion has been led to a chimney.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A system to treat odorous gases in a pulp mill comprising:

a combustion device having inputs receiving the odorous gases and combustion air, in which the odorous gases are combusted with excess air to oxidize compounds in the odorous gases, and having a discharge for flue gas generated by the combustion of the odorous gases;

a first stage of a scrubbing unit having a gas inlet receiving the flue gas from the combustion device, a solution inlet coupled to a source of a liquid scrubbing solution to mix with the received flue gas, an outlet for a liquid containing oxidized compounds extracted from the flue gas in the first stage and entrained in the liquid, and a gas outlet discharging scrubbed flue gas from the first stage, and a second stage of the scrubbing unit having a gas inlet receiving the scrubbed flue gas from the first stage, a solution inlet coupled to a source of a liquid scrubbing solution to mix with the received scrubbed flue gas, an outlet for a liquid containing oxidized compounds extracted from the received scrubbed flue gas in the second stage and entrained in the liquid, and a gas outlet for scrubbed flue gas from the second stage wherein the gas outlet directs the scrubbed flue gas to a recovery boiler.

2. The system of claim 1 wherein the combustion device is a fire tube boiler.

3. The system of claim 1 wherein the second stage of the scrubbing unit includes a first scrubber and a second scrubber, wherein the first scrubber receives the scrubbed flue gas from the first stage and the second scrubber receives scrubbed flue gas from the first scrubber, and the scrubbed flue gas from the second scrubber is fed to the recovery boiler.

4. The system of claim 3 wherein the outlet of the second scrubber is coupled to an inlet to the first scrubber.

5. The system of claim 1 wherein a gas discharge outlet of the second stage is coupled to a burner in a wall of the recovery boiler.

6. The system of claim 1 wherein the source of liquid scrubbing solution coupled to the solution inlet to the first stage contains the liquid scrubbing solution including sodium hydroxide.

7. The system of claim 1 wherein the source of the liquid scrubbing solution coupled to the second stage contains a liquid including oxidized white liquor.

8. A method for treating odorous gases in a pulp mill comprising:

combusting the odorous gases in a combustion device, wherein the combustion is performed with excess air to oxidize sulfur compounds in the odorous gases and generate flue gas including sulfur dioxide;

scrubbing the flue gas generated from the combustion of the odorous gases to remove the oxidized sulfur compounds, wherein the scrubbing includes mixing the flue gas with a liquid scrubbing solution;

separating the scrubbed flue gas from a liquid scrubbed solution resulting from the mixing of the flue gas and the liquid scrubbing solution, and feeding the scrubbed flue gas to a recovery boiler separate from the combustion device.

9. The method of claim 8 wherein the scrubbed flue gas is fed to the recovery boiler via a burner in a wall of the recovery boiler.

10. The method of claim 8 wherein the scrubbed flue gas is fed directly into the recovery boiler.

11. The method according to claim 8 wherein the scrubbing of the flue gas includes a first scrubbing stage in which the flue gas is mixed with the liquid scrubbing solution and the scrubbed flue gas from the first scrubbing stage is mixed with the liquid scrubbing solution in a second scrubbing stage, and the scrubbed flue gas from the second scrubbing stage is fed to the recovery boiler.

12. The method of claim 11 wherein the liquid scrubbing solution mixed with the flue gas in the first scrubbing stage includes sodium hydroxide.

13. The method of claim 12 wherein the scrubbed solution from the second scrubbing stage includes sodium bisulfite.

14. The method according to claim 11 wherein the second scrubbing stage includes at least first and second scrubbers wherein the scrubbed flue gas from the first scrubber in the second scrubbing stage flows to the second scrubber, and the scrubbed flue gas from the second scrubber is fed to the recovery boiler.

15. The method of claim 14 wherein the flue gas is scrubbed in the first scrubber of the second scrubbing stage with the liquid scrubbing solution which includes oxidized white liquor.

16. The method of claim 15 wherein the scrubbed solution discharged from the second scrubber of the second scrubbing stage is fed to the first scrubber of the second stage.

17. A method for treating odorous gases in a pulp mill comprising:

feeding the odorous gases to a combustion device and combusting the odorous gases in the combustion device separately from combusting other fluids produced by the pulp mill, wherein the combustion is performed with excess air to oxidize compounds in the odorous gases;

scrubbing in a first scrubbing stage flue gas generated in the combustion device from the combustion of the odorous gases to remove the oxidized compounds and discharging scrubbed flue gas from the first scrubbing stage, wherein the scrubbing in the first scrubbing stage includes mixing the flue gas with a liquid scrubbing solution and separating in the first scrubbing stage a liquid scrubbed solution from the scrubbed flue gas;

feeding the scrubbed flue gas from the first scrubbing stage to a second scrubbing stage;

scrubbing in the second scrubbing stage the scrubbed flue gas from the first scrubbing stage and discharging scrubbed flue gas from the second scrubbing stage, wherein the scrubbing in the second scrubbing stage includes mixing the scrubbed flue gas with a liquid scrubbing solution and separating in the second scrubbing stage a liquid scrubbed solution from the scrubbed flue gas, and feeding the scrubbed flue gas discharged from the second scrubbing stage to a recovery boiler.

18. The method of claim 17 wherein the liquid scrubbing solution in the first scrubbing stage includes sodium hydroxide.

19. The method according to claim 17 wherein the second scrubbing stage includes a first scrubber and a second scrubber, and the scrubbed flue gas from the first scrubbing stage is scrubbed in the first scrubber and the scrubbed flue gas discharged from the first scrubber of the second scrubbing stage is fed to the second scrubber, and the liquid scrubbing solution discharged from the second scrubber of the second scrubbing stage is fed to the first scrubber of the second scrubbing stage and used as the liquid scrubbing solution for scrubbing in the first scrubber.

20. The method of claim 19 wherein the liquid scrubbing solution mixed with the scrubbed flue gas in the first scrubber includes an oxidized white liquor.

21. A method for treating odorous gases in a pulp mill comprising:

combusting the odorous gases in a combustion device, wherein the combustion is performed with excess air to oxidize sulfur compounds in the odorous gases and generate flue gas including sulfur dioxide;

injecting the flue gas and a liquid solution including sodium hydroxide into a first scrubber, wherein the sodium hydroxide reacts with the sulfur dioxide in the flue gas to form a solution containing sodium bisulfite ($NaHSO_3$) and scrubbed flue gas having reduced sulfur dioxide as compared to the flue gases injected into the first scrubber;

separately discharging from the first scrubber a solution containing sodium bisulfite and the scrubbed flue gas;

injecting the scrubbed flue gas and an oxidized white liquor into at least one other scrubber, wherein the oxidized white liquor reacts with the scrubbed flue gas to form a solution containing sulfites;

separately discharging the solution containing the sulfites and a rescrubbed flue gas having reduced sulfur dioxide as compared to the scrubbed flue gas injected into the at least one other scrubber, and feeding the rescrubbed flue gas to a recovery boiler that is separate from the combustion device.

* * * * *